United States Patent [19]

Kallmann

[11] 4,328,663

[45] May 11, 1982

[54] TWO-FOR-ONE SPINNING OR TWISTING SPINDLE HAVING A COMPRESSED-AIR-OPERATED THREADING ARRANGEMENT

[75] Inventor: Jürgen Kallmann, Kaarst, Fed. Rep. of Germany

[73] Assignee: Palitex Project-Company GmbH, Krefeld, Fed. Rep. of Germany

[21] Appl. No.: 176,702

[22] Filed: Aug. 11, 1980

[30] Foreign Application Priority Data

Sep. 29, 1979 [DE] Fed. Rep. of Germany ..... 2939702

[51] Int. Cl.[3] ..... D01H 7/86; D01H 15/00

[52] U.S. Cl. ..... 57/279; 57/58.49; 57/58.7

[58] Field of Search ..... 57/58.7, 58.49, 58.86, 57/58.83, 279, 280

[56] References Cited

U.S. PATENT DOCUMENTS

| | | | |
|---|---|---|---|
| 3,731,478 | 5/1973 | Franzen | 57/279 X |
| 3,945,184 | 3/1976 | Franzen | 57/58.86 |
| 3,975,893 | 8/1976 | Franzen | 57/279 |
| 4,168,605 | 9/1979 | D'Agnolo | 57/279 |

*Primary Examiner*—John Petrakes

[57] ABSTRACT

There is described a two-for-one spinning or twisting spindle in which thread drawn from a take-up package is threaded through from the bottom upwards by means of a compressed-air-operated threading arrangement so that it can be connected to thread, coming from a supply package, at the top end of a thread entry tube. In the arrangement shown, a thread storage disc of a two-for-one twisting spindle has therein a thread exit passage 8 the inner end of which opens into a short tube 10 which opens in turn into a hollow shaft 12 of the spindle, leaving an annular gap 11. In operation of the threading arrangement, compressed air is fed into a hollow shank 5 of the spindle from below and flows upwards through the annular gap 11. Because of this the short tube 10 acts as an injector nozzle which sucks the thread into the thread exit passage 8 from the side and transports it upwards through the hollow shaft 12 of the spindle. The thread can thus be knotted at the top end of the spindle which means that the spindle and take-up bobbin do not need to start up at different times as was previously necessary. In another embodiment, compressed air can be supplied to an injector arrangement through a passage in a floor of a protective pot.

4 Claims, 3 Drawing Figures

TWO-FOR-ONE SPINNING OR TWISTING SPINDLE HAVING A COMPRESSED-AIR-OPERATED THREADING ARRANGEMENT

The invention relates to a two-for-one spinning or twisting spindle. There is described herein a two-for-one spinning or twisting spindle having a supply package carrier which is held stationary, a thread storage member which is situated beneath the latter and which forms part of the spindle rotor and which has a thread exit passage extending substantially radially, and a compressed-air operated threading arrangement situated in the region occupied by a hollow shaft of the spindle, and by which arrangement a thread is able to be sucked in by injector effect and fed onward in a predetermined direction by a jet of compressed air.

Known compressed-air threading arrangements for two-for-one twisting spindles, such as those described in U.S. Pat. No. 3,731,478 and U.S. Pat. No. 3,975,893 for example, are so formed and so positioned within the twisting spindle that when compressed air is applied to the injector arrangement or nozzle a suction-induced flow of air is produced at the upper inlet end or top of a thread entry tube by which the thread is sucked into the thread entry tube and fed onwards and outwards radially through the thread storage member or rather the thread exit passage in the thread storage member, by the jet of compressed air emerging from the injector nozzle. Thus, known pneumatic threading arrangements involve threading in the thread in a two-for-one twisting spindle from the top downwards, that is to say that in these known arrangements the thread becomes subject to the suction-induced flow produced by the injector arrangement at the top of the entry tube and is fed by the flow of air through the hollow shaft of the spindle towards the spindle rotor and is then fed by it through the thread exit passage in the thread storage member. Having emerged from the rotor spindle or rather the thread storage member, the thread then follows a path between the inner face of a balloon limiting device and a protective pot. The thread is then passed, either automatically or by hand, to a take-up section of the spindle.

In the event that a break in the thread has to be mended, where the pneumatic threading of the thread takes place in the above manner the threaded thread is generally knotted between the top edge of the balloon limiter and a wire thread guide. Proposals also exist for the thread to be knotted in the region occupied by the spindle rotor for example.

Where the known method of pneumatic thread threading calls for the thread to be knotted in this way, it is necessary for the spindle and take-up arrangement to be started up again at different times in order to ensure that there is the predetermined amount of thread twist per meter, that is to say the take-up arrangement must start up with a delay relative to the spindle.

U.S. Pat. No. 2,715,308 discloses a twisting arrangement which operates in a similar way to a two-for-one spindle and in which a thread drawn from a supply package is fed from above to a hollow spindle which includes a complete take-up unit. The thread coming from the supply package rotates about the hollow spindle in the form of a balloon and is fed inwards axially through a rotating vane to the hollow shaft of the spindle, through which it travels on to the take-up unit. In the region of the hollow shaft, this known twisting spindle has a compressed-air-operated thread threading arrangement in which the thread, which is applied to the outside of the disc-shaped vane, is sucked inwards radially and is fed on through the hollow shaft of the spindle to the take-up unit by the jet of compressed air. In this known arrangement too, it is necessary for the spindle and take-up unit to start up again at different times so that, when a break in the thread has been repaired, it is ensured that there is the predetermined amount of thread twist per meter. Apart from this, it is also not clear with this known arrangement how, in the event of thread breakage, the thread makes its way out of the take-up area and back to a knotting point situated outside the hollow spindle.

The object of the invention is to form a two-for-one spinning or twisting spindle with a compressed air-operated threading arrangement in such a way that on the one hand it is possible to preserve the advantage of automated thread threading, which is particularly important from the point of view of time, while on the other hand the problems which exist with known pneumatic threading procedures in connection with the staggered restarting of the spindle and take-up unit are overcome.

To enable this object to be achieved, according to the invention there is provided a two-for-one spinning or twisting spindle having a supply package carrier which is held stationary, a thread storage member which is situated beneath the latter and which forms part of the spindle rotor and which has a substantially radially-extending thread exit passage, and a compressed-air-operated threading arrangement situated in the region occupied by a hollow shaft of the spindle and by which a thread is able to be sucked in by injector action and fed onward by a jet of compressed air in a predetermined direction, characterized in that a suction orifice of the injector nozzle of the threading arrangement continues on from the inner end of the thread exit passage, while an outlet orifice of the injector nozzle is directed towards or into the bottom end of a thread entry tube in the opposite direction to the direction of movement of the thread from the supply package during the twisting process. With an arrangement of this kind, when a break in the thread is to be repaired the thread is threaded through from the outer circumference of the thread storage member towards the hollow shaft of the spindle to the topmost point of the thread entry tube. In this case the thread can be knotted between the topmost point of the entry tube and the delivery or supply package. Thus, the thread which is brought back from the take-up package for the purposes of threading is at least partially twisted, thus ensuring that if the spindle and take-up or wind-on unit start up simultaneously, the section of untwisted thread coming from the supply package will receive the requisite amount of twist as it passes through the spindle.

Despite the fact that it partly untwists or untwines, it is true that the length of thread which is threaded through the spindle from the take-up package becomes over-twisted to some degree. However, this does not matter greatly since the spindle is in the starting up or running-up phase and thread is being wound on by the take-up package at the same time. In addition, textile materials have the property of evening out the twist within certain free lengths of thread which have not set. Thus, as an example, the twist from twisted sections of thread spreads to sections which were not twisted up to that point or which were less twisted than an adjoining section.

The infeed of air to the threading injector of the spindle may preferably take place through the hollow shank of a bottom mounting for the spindle. For this purpose a nozzle connected to a source of compressed air may be moved up against the end of the hollow shank from a rest position to a connected position, whereby to release the compressed air whereby it flows through the hollow shank to a distribution chamber in the spindle of the rotor a short distance below an upper bearing arrangement of the spindle. From there the air can flow into an injector gap and on towards the end of the entry tube.

When the threading arrangement operates, the thread coming from the take-up package is taken hold of by the flow of sucked-in air in the vicinity of the opening in the thread storage member, i.e. the opening of the thread exit passage, is sucked through the rotor towards the hollow shaft of the spindle and is there picked up by the flow of compressed air and conveyed by this to the orifice at the top of the thread entry tube, where it can be taken hold of by an operator or a knotting arrangement.

Another preferred embodiment of the invention has the injector nozzle arranged directly above the spindle rotor concentrically therewith and has a short tube which projects on the one hand into the rotor of the spindle and on the other hand into the thread entry tube, which is held stationary, the said short tube being surrounded inside the thread entry tube by an annular gap into which opens a connecting passage for compressed air which can be connected to a source of compressed air and which runs through a carrier for the supply package. With an arrangement of this nature it is possible for the threading arrangement to operate irrespective of the position of the spindle rotor, the supply of compressed air to the injector nozzle coming, in essence, only through stationary parts of the spindle.

Also, according to the invention there is provided a two-for-one spinning or twisting spindle having a supply package carrier which is held stationary, a thread storage member which is situated beneath the latter and which forms part of the spindle rotor and which has a substantially radially extending thread exit passage, and a compressed-air-operated threading arrangement by which a thread is able to be sucked in by injector action and fed onward by a jet of compressed air in a predetermined direction, characterized in that the compressed-air-operated threading arrangement is so arranged as to be operable, to effect a threading operation, to cause a thread end to be drawn by suction through the thread exit passage from the outer end thereof and to be fed upwards to leave the spindle through the upper end of a thread entry passage thereof, the thread, when being thus threaded through the spindle, passing through the spindle in a direction opposite to the direction of thread travel during the twisting process.

In the accompanying drawings, which show, by way of example, two embodiments constructed in accordance with the invention:

Figure 1:
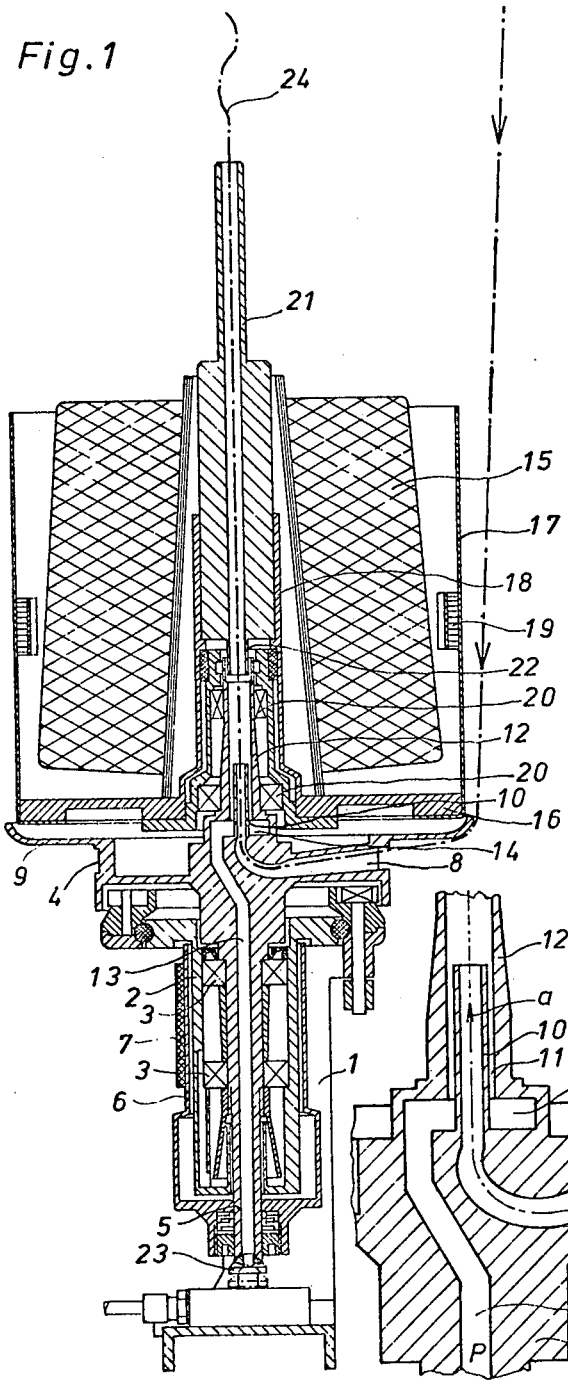
FIG. 1 is a partial section through a first embodiment constructed in accordance with the invention.

Referring to the drawings, the two-for-one twisting spindle shown in FIG. 1 has a supporting sleeve 2 for bottom bearings of the spindle, the sleeve 2 being fastened in a fixed position to a frame 1 of which only part is shown. A hollow shank 5 which is situated on the underside of a thread storage disc 4 is mounted in the sleeve 2 in bearings 3. Connected to be solid in rotation with the hollow shank 5 is a wharve 6 of the spindle which can be driven by a tangential drive belt 7.

The thread storage disc 4 has a thread exit passage 8 which is substantially radially orientated and said disc carries at the top a rotating plate 9.

Also, to hold a supply package 15, the two-for-one spindle includes a carrier, for the supply package, which is composed in essence of the floor 16 of the protective pot, the protective pot member 17 and the hollow boss 18 of the protective pot. The protective pot member 17 carries immobilizing magnets 19 which cooperate in conventional fashion with fixed magnets (not shown) to hold the supply package carrier in position. The hollow boss 18 of the protective pot is mounted on the spindle rotor, or rather the hollow shaft 12 of the spindle, with bearings 20 interposed.

Inserted in the hollow boss 18 of the protective pot is a thread entry tube 21 which at the bottom end is provided with a tubular projection 22 which is situated opposite the outlet orifice at the top of the rotatable hollow shaft 12 of the spindle.

Figure 2:
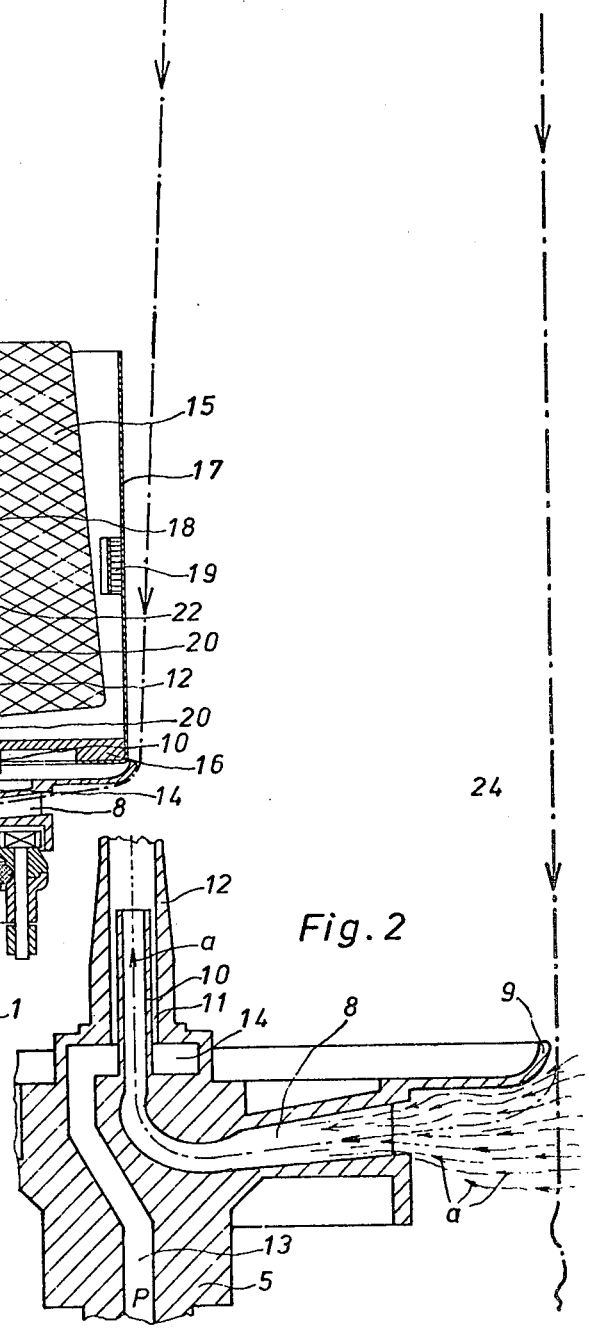
FIG. 2 is a detailed view, on a larger scale, of the injector arrangement shown in FIG. 1.

The central inner end of the thread exit passage 8 opens into a short tube 10 which opens into the hollow shaft 12 of the spindle (which shaft is situated on the thread storage disc and rotates with it) while leaving an annular gap 11 (see FIG. 2). A passage 13 for compressed air formed by the interior of the hollow shank 5 is connected to the annular gap 11 by an annular chamber 14 situated in the thread storage disc 4.

In conjunction with the annular gap 11 and the hollow shaft 12 of the spindle the short tube 10 forms an injector nozzle so that, when compressed air is fed through the hollow shank 5 from below, the compressed air, on emerging from the annular gap 11, produces an induced flow of air in the short tube 10 by injector action, which flow reaches as far as the outer end of the thread exit passage 8 in the thread storage disc 4 and is represented in FIG. 2 by the arrows a.

As already mentioned, the air is fed to the injector nozzle of the spindle through the hollow shank 5 forming the bottom mounting for the spindle. To feed in the compressed air, a nozzle 23 connected to a source of compressed air is moved up tight against the end of the hollow shank 5 from the position shown in chain lines to the position shown in solid lines.

When the threading-in arrangement operates, the thread 24 coming from the take-up package is taken hold of by the flow of sucked-in air a in the vicinity of the opening in the thread storage disc (see FIG. 2), is sucked through the thread exit passage 8 in the thread storage disc inwards towards the hollow shaft 12 of the spindle and is there picked up by the flow of compressed air, which feeds the thread onwards and upwards through the thread entry tube 21, where the thread can be taken hold of by an operator or a knotting arrangement so that it can be knotted to the end of the thread coming from the supply package 15.

Figure 3:
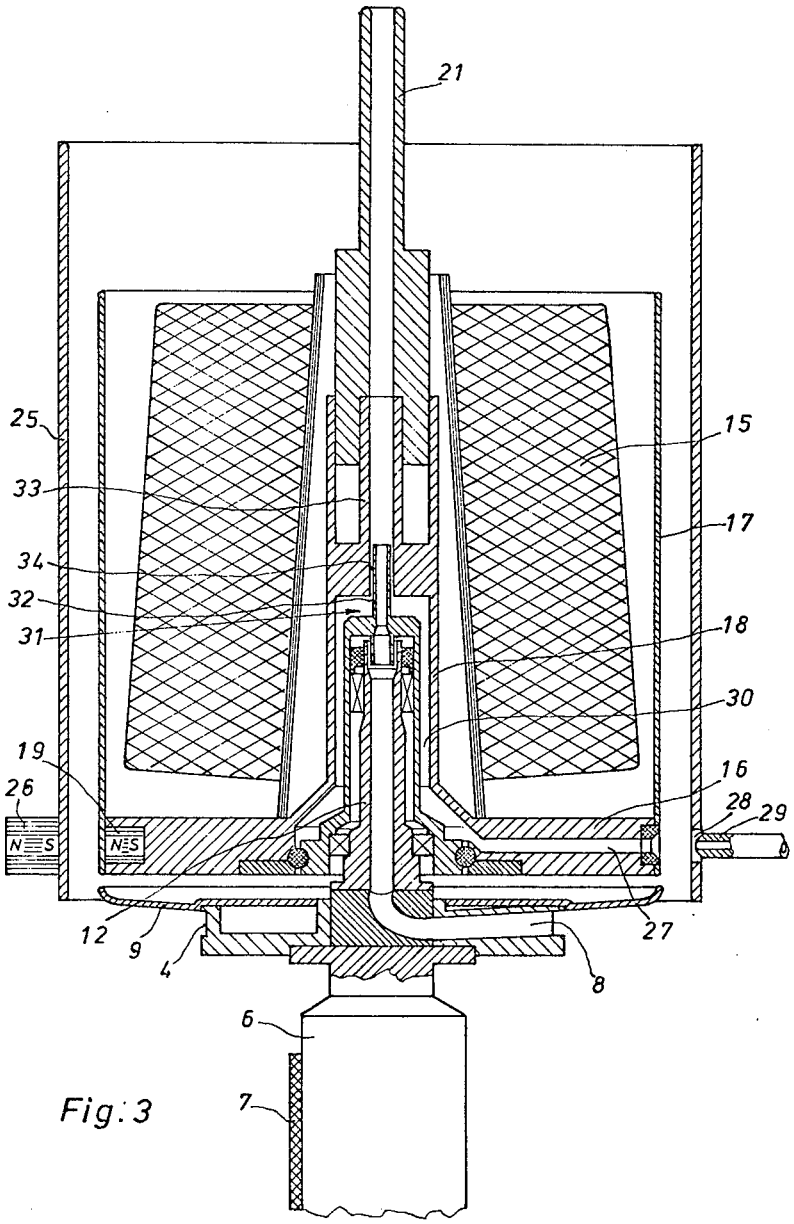
FIG. 3 is a partial section through a modified embodiment of two-for-one spindle constructed in accordance with the invention.

The two-for-one spindle shown in FIG. 3 also comprises a wharve 6, a rotating plate 9 with a thread storage disc 4, and a supply package carrier, carrying a supply package 15, which comprises the floor 16 of a protective pot member 17 and the hollow boss 18 of the protective pot. Inserted in the floor 16 of the protective pot are immobilizing magnets 19 which co-operate with fixed magnets 26 arranged outside a balloon limiter 25, to hold the supply package carrier in position.

The floor 16 of the protective pot is provided with a radially-extending section 27 of a connecting passage for compressed air. The outer end of section 27 of the passage is situated opposite an opening 28 in the balloon limiter 25. A connecting piece 29 which communicates with a source of compressed air can be inserted through this opening 28 to enable compressed air to be supplied to the passage section extending through the floor 16 of the protective pot.

Following on from the inner end of the radially-extending passage section 27 is an annular passage section 30 which extends through the hollow boss 18 of the protective pot and leads to an injector nozzle 31. This injector nozzle 31 is situated directly above the spindle rotor, or rather the hollow shaft 12 of the spindle, in a concentric position and comprises a short tube 32 which projects on the one hand into the spindle rotor, or rather the hollow shaft 12 of the spindle and on the other hand into the thread entry tube 21, which is held stationary, and inside the thread entry tube 21, or rather an extension 33 of the thread entry tube, it is surrounded by an annular gap 34 which communicates with the annular passage section 30.

When a thread is to be threaded through the spindle, the connecting piece 29 is connected to the passage section 27 so that, once a valve (not shown) has been operated, compressed air can flow through the passage section 27 and the annular passage section 30 to the injector nozzle 31, i.e. into and through the annular gap 34. If an end of thread is held in front of the opening in the thread storage disc, i.e. the orifice of the thread exit passage 8, it will then be taken hold of by the flow of sucked-in air produced in the thread exit passage 8 and the hollow shaft 12 of the spindle in substantially the manner described in connection with FIGS. 1 and 2 and after passing through the short tube 32 will be carried onwards and upwards through the thread entry tube 21 by the jet of compressed air. When it emerges at the top from the thread entry tube 21 the end of the thread can then be knotted to the end of thread coming from the supply package 15.

I claim:

1. A two-for-one twisting spindle comprising; a spindle rotor having a hollow shaft, said shaft having a thread exit opening, a stationary supply package carrier having a supply package of thread mounted on said rotor, a thread storage member positioned beneath said supply package carrier, a thread exit line extending substantially radially from said storage member, an injector nozzle connected within said hollow shaft and forming an annular gap therebetween, compressed air operated threading means to supply compressed air to said thread exit line and said hollow shaft through said injector nozzle to cause a thread to be drawn by suction through said thread exit passage and said hollow shaft which thread is supplied from said thread storage member, said injector nozzle forming a continuation of said thread exit line and directed towards said thread exit opening, said compressed air operated threading means creating a suction through said thread exit line and said hollow shaft through said injector nozzle and said spindle hollow shaft to be drawn in a predetermined direction opposite to the direction of thread travel during the twisting process whereby a moving thread drawn by suction may be connected to a thread from said supply package during normal operation of said spindle.

2. A two-for-one twisting spindle as claimed in claim 1, said injector nozzle having a short tube connected to said thread exit line and extending into said hollow shaft of the spindle in the opposite direction to the direction of movement of a thread from said supply package during the twisting process, said short tube being surrounded by an annular gap inside said hollow shaft of said spindle, said gap extending upwardly for compressed air to flow as a continuation of the compressed air supply through said thread storage chamber from below.

3. A two-for-one twisting spindle as claimed in claim 2, a concentric hollow shank connected to said annular gap formed by said short tube in said hollow shaft of said spindle, a spindle foot bearing assembly, said hollow shank extending downwardly of said spindle to said spindle foot bearing assembly and to receive compressed air through said compressed air operated threading means.

4. A two-for-one twisting spindle as claimed in claim 1, said injector nozzle coaxially positioned above said hollow shaft of the spindle and having a short tube projecting from one end into said hollow shaft of the spindle and on the other end into said thread exit line, said short tube being surrounded inside said hollow shaft of the spindle by an annular gap, said annular gap opening into a connecting passage to receive compressed air which passes through said carrier from a source of compressed air.

* * * * *